US007082993B2

(12) United States Patent
Ayoub et al.

(10) Patent No.: US 7,082,993 B2
(45) Date of Patent: Aug. 1, 2006

(54) MEANS AND METHOD FOR ASSESSING THE GEOMETRY OF A SUBTERRANEAN FRACTURE DURING OR AFTER A HYDRAULIC FRACTURING TREATMENT

(75) Inventors: Joseph Ayoub, Katy, TX (US); Stuart Jardine, Houston, TX (US); Peter Fitzgerald, Paris (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/064,990

(22) Filed: Feb. 24, 2005

(65) Prior Publication Data

US 2005/0183858 A1 Aug. 25, 2005

Related U.S. Application Data

(62) Division of application No. 10/249,523, filed on Apr. 16, 2003, now abandoned.

(60) Provisional application No. 60/374,217, filed on Apr. 19, 2002.

(51) Int. Cl.
*E21B 47/00* (2006.01)
*E21B 49/00* (2006.01)
*E21B 43/267* (2006.01)

(52) U.S. Cl. ..... 166/250.1; 166/280.2

(58) Field of Classification Search ..... 166/250.1, 166/280.2, 308.1, 66, 113
See application file for complete search history.

(56) References Cited

U.S. PATENT DOCUMENTS

| | | | | |
|---|---|---|---|---|
| 3,227,211 A | | 1/1966 | Gilchrist | 166/259 |
| 3,239,006 A | | 3/1966 | Fast | 166/42 |
| 3,760,880 A | | 9/1973 | Dollarhide | 166/276 |
| 4,340,405 A | | 7/1982 | Steyert, Jr. et al. | 65/514 R |
| 4,491,796 A | | 1/1985 | Smith | 324/346 |
| 4,550,779 A | | 11/1985 | Zakiewicz | 166/248 |
| 4,567,945 A | | 2/1986 | Segalman | 166/248 |
| 4,823,166 A | | 4/1989 | Hartog et al. | 356/44 |
| 4,848,461 A | * | 7/1989 | Lee | 166/250.1 |
| 5,243,190 A | | 9/1993 | Bandy et al. | 250/260 |
| 5,322,126 A | | 6/1994 | Scott, III | 166/308 |

(Continued)

FOREIGN PATENT DOCUMENTS

GB 2133882 8/1984

(Continued)

OTHER PUBLICATIONS

Wholdart, Stephen, "Advanced hydraulic fracture diagnostics optimize development in the Bossier Sands", Jul. 2005, WorldOil, 10 pages.*

(Continued)

*Primary Examiner*—Jennifer H. Gay
(74) *Attorney, Agent, or Firm*—Thomas O. Mitchell; Tim Carington; Robin Nava

(57) ABSTRACT

A method is given of fracturing a subterranean formation including the step of a) pumping at least one device actively transmitting data that provide information on the device position, and further comprising the step of assessing the fracture geometry based on the positions of said at least one device, or b) pumping metallic elements, preferably as proppant agents, and further locating the position of said metallic elements with a tool selected from the group consisting of magnetometers, resistivity tools, electromagnetic devices and ultra-long arrays of electrodes, and further comprising the step of assessing the fracture geometry based on the positions of said metallic elements. The method allows monitoring of the fracture geometry and proppant placement.

15 Claims, 1 Drawing Sheet

U.S. PATENT DOCUMENTS

| | | | | |
|---|---|---|---|---|
| 5,358,047 | A | 10/1994 | Himes et al. | 166/280 |
| 5,439,055 | A | 8/1995 | Card et al. | 166/280 |
| 5,501,275 | A | 3/1996 | Card et al. | 166/280 |
| 5,592,282 | A | 1/1997 | Hartog | 356/44 |
| 5,871,049 | A | 2/1999 | Weaver et al. | 166/276 |
| 5,908,073 | A * | 6/1999 | Nguyen et al. | 166/276 |
| 5,963,508 | A * | 10/1999 | Withers | 367/38 |
| 6,059,034 | A | 5/2000 | Rickards et al. | 166/280 |
| 6,116,342 | A | 9/2000 | Clark et al. | 166/280 |
| 6,330,914 | B1 * | 12/2001 | Hocking et al. | 166/250.1 |
| 6,408,943 | B1 * | 6/2002 | Schultz et al. | 166/285 |
| 6,691,780 | B1 | 2/2004 | Nguyen et al. | 166/254.1 |
| 6,719,053 | B1 | 4/2004 | Thompson | 166/305.1 |
| 6,725,930 | B1 | 4/2004 | Boney et al. | 166/280.2 |
| 6,735,630 | B1 | 5/2004 | Gelvin et al. | 709/224 |
| 6,776,235 | B1 * | 8/2004 | England | 166/271 |
| 6,826,607 | B1 | 11/2004 | Gelvin et al. | 709/224 |
| 6,832,251 | B1 | 12/2004 | Gelvin et al. | 709/224 |
| 6,834,233 | B1 * | 12/2004 | Economides et al. | 702/1 |
| 6,859,831 | B1 | 2/2005 | Gelvin et al. | 709/224 |
| 2002/0066309 | A1 * | 6/2002 | Tubel et al. | 73/152.54 |
| 2003/0196799 | A1 | 10/2003 | Nguyen et al. | 166/250.12 |
| 2003/0196800 | A1 | 10/2003 | Nguyen et al. | 166/254.1 |
| 2003/0205376 | A1 * | 11/2003 | Ayoub et al. | 166/254.2 |
| 2004/0040707 | A1 * | 3/2004 | Dusterhoft et al. | 166/279 |
| 2004/0045705 | A1 * | 3/2004 | Gardner et al. | 166/250.01 |
| 2004/0129418 | A1 * | 7/2004 | Jee et al. | 166/250.01 |
| 2004/0226715 | A1 * | 11/2004 | Willberg et al. | 166/250.1 |

FOREIGN PATENT DOCUMENTS

| | | |
|---|---|---|
| GB | 2404253 | 1/2005 |
| GB | 2404253 A * | 1/2005 |
| JP | 06066950 | 3/1994 |
| WO | 0029716 | 5/2000 |
| WO | 01/26334 | 4/2001 |
| WO | 03089757 | 10/2003 |
| WO | WO 3089757 A1 * | 10/2003 |

OTHER PUBLICATIONS

The University of Oklahoma, "Fracturing Fluid Characterization Facility", Dec. 1992, The University of Oklahoma, 7 pages.*

Wholdart, Stephen, "Advanced Hydraulic Fracture Diagnostics Optimize Development in the Bossier Sands", Jul. 2005, WoldOil.

The University of Oklahoma, "Fracturing Fluid Characterization Facility", Dec. 1992, The University of Oklahoma.

Metweb, Rockwell C Hardness for White Cast Iron, www.matweb.com/search/GetProperty.asp.

Newage Testing Instruments, Inc. Rockwell Scales, www.hardnesstesters.com/rockwell-scales1.htm.

Matweb.com, The Online Materials Database, Class 1 Type A Ni-Cr-HC Martenstiic White Cast Iron, www.matweb.com/search/specificMaterialPrint.asp.

Matweb.com, The Online Materials Database, Class III Type E 25% Cr Martensitic White Cast Iron, www.matweb.com/search/specificMaterialPrint.asp.

Matweb.com, The Online Materials Database, Class II Type C 15% Cr-Mo-HC Martensitic White Cast Iron, www.matweb.com/search/specificMaterialPrint.asp.

* cited by examiner

MEANS AND METHOD FOR ASSESSING THE GEOMETRY OF A SUBTERRANEAN FRACTURE DURING OR AFTER A HYDRAULIC FRACTURING TREATMENT

This Application is a Divisional of Non-Provisional patent application Ser. No. 10/249,523, filed Apr. 16, 2003, now abandon, which claimed the benefit of Provisional Patent Application Ser. No. 60/374,217, filed Apr. 19, 2002.

TECHNICAL FIELD OF THE INVENTION

This invention relates generally to the art of hydraulic fracturing in subterranean formations and more particularly to a method and means for assessing the fracture geometry during or after hydraulic fracturing.

BACKGROUND OF THE INVENTION

Hydraulic fracturing is a primary tool for improving well productivity by placing or extending cracks or channels from the wellbore to the reservoir. This operation is essentially performed by hydraulically injecting a fracturing fluid into a wellbore penetrating a subterranean formation and forcing the fracturing fluid against the formation strata by pressure. The formation strata or rock is forced to crack, creating or enlarging one or more fractures. Proppant is placed in the fracture to prevent the fracture from closing and thus provide improved flow of the recoverable fluid, i.e., oil, gas or water.

The proppant is thus used to hold the walls of the fracture apart to create a conductive path to the wellbore after pumping has stopped. Placing the appropriate proppant at the appropriate concentration to form a suitable proppant pack is thus critical to the success of a hydraulic fracture treatment.

The geometry of the hydraulic fracture placed directly affects the efficiency of the process and the success of the operation. This geometry is generally inferred using models and data interpretation, but, to date, no direct measurements are available. The present invention is aimed at obtaining more direct measurements of the fracture geometry (e.g. length, height away from the wellbore).

The fracture geometry is often inferred through use of models and interpretation of pressure measurements. Occasionally, temperature logs and/or radioactive tracer logs are used to infer fracture height near the wellbore. Microseismic events generated in the vicinity of the created hydraulic fracture are recorded and interpreted to indicate the direction (azimuth) and length and height of the created fracture.

However, these known methods are indirect measurement, and rely on interpretations that may be erroneous, and are difficult to use for real-time evaluation and optimization of the hydraulic fracture treatment.

It is therefore an object of the present invention to provide a new approach to evaluate the fracture geometry.

SUMMARY OF THE INVENTION

According to the present invention, the fracture geometry is evaluated by placing inside the fracture small devices that, either actively or passively, give measurements of the fracture geometry. Fracture materials (small objects with distinctive properties e.g. metal beads with very low resistivity) or devices (e.g. small electronic or acoustic transmitters) are introduced into the fracture during the fracture treatment with the fracturing fluid.

According to a first embodiment of the present invention, active devices are added into the fracturing fluid. These devices then actively transmit data that provide information on the device position and, thereafter, the device position can be associated with fracture geometry.

According to another embodiment of the present invention, passive devices are added to the fracturing fluid. In the preferred embodiment, these passive devices are also used as proppant.

DETAILED DESCRIPTION AND PREFERRED EMBODIMENTS

Figure 1:
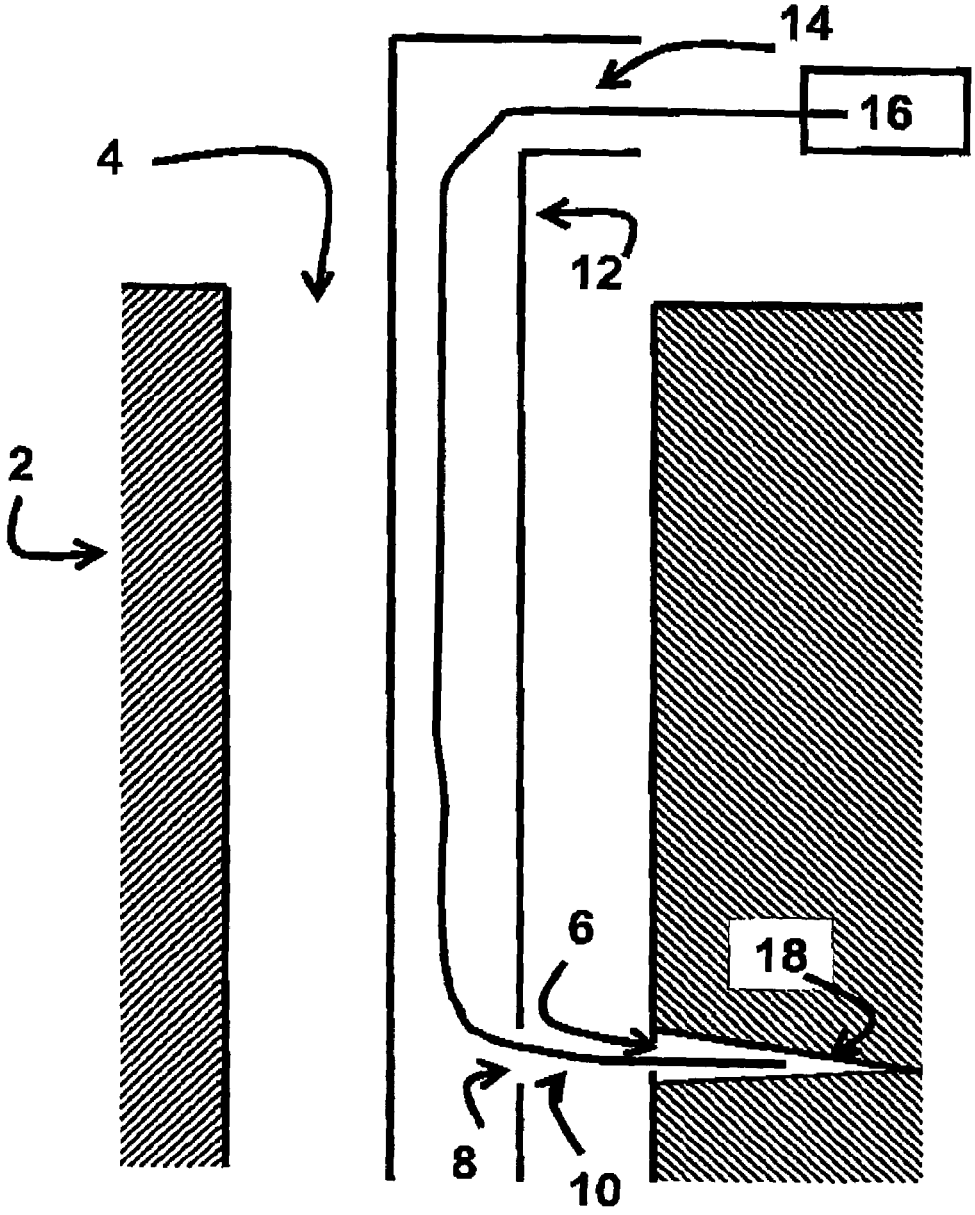
FIG. 1 shows an optical fiber deployed into a fracture according to one embodiment of the Invention.

Examples of "active" devices include electronic microsensors, for example radio frequency transmitters, or acoustic transceivers. These "active" devices are integrated with location tracking hardware to transmit their position as they flow with the fracture fluid/slurry inside the created fracture. The microsensors are pumped with the hydraulic fracturing fluids throughout the treatment or during selected strategic stages of the fracturing treatment (pad, forward portion of the proppant-loaded fluid, tail portion of the proppant-loaded fluid) to provide a direct indication of the fracture length and height. The microsensors form a network using wireless links to neighboring microsensors and have location and positioning capability through, for example, local positioning algorithms.

Pressure and temperature sensors are also integrated with the above-mentioned active devices. The resulting pressure and temperature measurements are used to calibrate and advance the modeling techniques better for hydraulic fracture propagation. They also allow optimization of the fracturing fluids by indicating the actual conditions under which these fluids perform. In addition, chemical sensors are also integrated with the above-mentioned active devices to allow monitoring of the fluid performance during the treatment.

Since the number of active devices required is small compared to the number of proppant grains, it is possible to use devices significantly bigger than the proppant pumped in the fracturing fluid. The active devices may be added after the blending unit and slurry pump, for instance through a lateral by-pass.

Examples of such devices include small wireless sensor networks that combine microsensor technology, low power distributed signal processing, and low cost wireless networking capability in a compact system, as disclosed for instance in International Patent Application WO0126334, preferably using a data-handling protocol such as TinyOS© (an event based operating environment designed for use with embedded networked sensors, copyrighted by The Regents of the University of California), so that the devices organize themselves into a network by listening to one another, therefore allowing communication from the tip of the fracture to the well and on to the surface even if the signals are weak, so that the signals are relayed from the farthest devices towards the devices closest to the recorder to allow uninterrupted transmission and capture of data. The sensors may be designed using MEMS technology or the spherical shaped semiconductor integrated circuit as known from U.S. Pat. No. 6,004,396.

A recorder placed at the surface or downhole in the wellbore, may capture and record/transmit the data sent by the devices to a computer for further processing and analysis. The data may also be transmitted to offices in any part of the world using the Internet to allow remote participation in decisions affecting the hydraulic fracturing treatment outcome.

Should the frequency range utilized by the electronic transmitters be such that the borehole metal casing would block its transmission from the formation behind the casing into the wellbore, antennas may be deployed across the perforation tunnels. These antennas may be mounted on non-conductive spherical or ovoid balls slightly larger than the perforation diameter and designed to be pumped and to seat in some of the perforations and relay the signals across the metallic casing wall. An alternative method of deployment is for the transmitter to trail an antenna wire while being pumped.

In a further variant, the measuring devices are optical fibers with a physical link to a recorder at the surface or in the borehole that is deployed through the perforations when the well is cased and perforated or directly into the fracture in an open hole situation. The optical fiber allows length measurements as well as pressure and temperature measurements.

FIG. 1 shows an optical fiber [10] deployed through a pipe or tubing string [12] that provides a fluid flow path [14] in a wellbore [4] penetrating a formation [2]. The optical fiber is connected at the suffice by a physical link to a recorder [16] and passes through an opening [8] in the pipe or tubing string [12] and then through a perforation [6] into a fracture [18].

An important alternative embodiment of this invention is the use of materials with specific properties that enable information about the fracture geometry to be obtained using an additional measurement device.

Specific examples of "passive" materials include the use of metallic fibers or beads as proppant. These may replace some or all of the conventional proppant and may have sufficient compressive strength to resist crushing at fracture closure. A tool to measure resistivity at varying depths of investigation is deployed in the borehole of the fractured well. Because the proppant is conductive with a significant contrast in resistivity compared to the surrounding formations, the resistance measurements may be interpreted to provide information on fracture geometry.

Another example is the use of ferrous/magnetic fibers or beads. These may replace some or all of the conventional proppant and may have sufficient compressive strength to resist crushing at fracture closure. A tool containing magnetometers is deployed in the borehole of the fractured well. Because the proppant generates a significant contrast in magnetic field compared to the surrounding formations, the magnetic field measurements may be interpreted to provide information on fracture geometry. In a variant of this example, the measuring tools are deployed on the surface or in offset wells. More generally, tools such as resistivity tools, electromagnetic devices, and ultra long arrays of electrodes, can easily detect this proppant, enabling fracture height, fracture width, and, with processing, the propped fracture length to be determined to some extent.

In a further step, the information provided by the techniques described above may be used to calibrate parameters in a fracture propagation model to allow more accurate design and implementation of fractures in nearby wells in geological formations with similar properties and to allow immediate action on the design of the fracture being placed to further the economic outcome.

For example, if the measurements indicate that the fracture treatment is confined to only a portion of the formation interval being treated, real time design tools may validate suggested actions, e.g. increasing the rate and viscosity of the fluid or using ball sealers to divert the fluid and treat the remainder of the interval of interest.

If the measurements indicate that the sought after tip screenout has not yet occurred in a typical Frac and Pack treatment and that the fracture created is still at a safe distance from a nearby water zone, the real time design tool may be re-calibrated and used to validate an extension of the pump schedule. This extension may incorporate injection of additional proppant laden slurry to achieve the tip screenout necessary for production performance enhancement, while not breaking through into the water zone.

The measurements may also indicate the success of special materials and pumping procedures that are utilized during a fracture treatment to keep the fracture confined away from a nearby water or gas zone. This knowledge may allow either proceeding with the treatment with confidence of its economic success, or taking additional actions, e.g. re-design or repeating the use of the special pumping procedure and materials to ensure better success at staying away from the water zone.

Among the "passive" materials, metallic particles may be used. These particles may be added as a "filler" to the proppant or may replace part of the proppant. In a most preferred embodiment, metallic particles consisting of an elongated particulate metallic material, wherein individual particles of said particulate material have a shape having a length-basis aspect ratio greater than 5 are used both as proppant and "passive" materials.

Advantageously, the use of metallic fibers as proppant contributes to enhanced proppant conductivity and is further compatible with techniques known to enhance proppant conductivity such as the use of conductivity enhancing materials (in particular the use of breakers) and the use of non-damaging fracturing base fluids such as gelled oils, viscoelastic surfactant based fluids, foamed fluids and emulsified fluids.

In all embodiments of the disclosed invention, in which at least part of the proppant consists of metallic material, at least part of the fracturing fluid comprises a proppant essentially consisting essentially of an elongated particulate metallic material, said individual particles of said particulate material having a shape with a length-basis aspect ratio greater than 5. Though the elongated material is most commonly a wire segment, other shapes such as ribbon or fibers having a non-constant diameter may also be used, provided that the length to equivalent diameter is greater than 5, preferably greater than 8, and most preferably greater than 10. According to a preferred embodiment, the individual particles of said particulate material have a length ranging between about 1 mm and 25 mm, most preferably ranging between about 2 mm and about 15 mm, most preferably from about 5 mm to about 10 mm. Preferred diameters (or equivalent diameter where the cross-section is not circular) typically range between about 0.1 mm and about 1 mm and most preferably between about 0.2 mm and about 0.5 mm. It must be understood that depending upon the process of manufacturing, small variations of shapes, lengths and diameters are normally expected.

The elongated material is substantially metallic but can include an organic part, such as a resin coating. Preferred metals include iron, ferrite, low carbon steel, stainless steel and iron-alloys. Depending upon the application, and more particularly upon the closure stress expected to be encountered in the fracture, "soft" alloys may be used, though metallic wires having a hardness between about 45 and about 55 Rockwell C are usually preferred.

The wire-proppant of the invention can be used during the whole propping stage or to prop only part of the fracture. In one embodiment, the method of propping a fracture in a subterranean formation comprises two non-simultaneous steps of placing a first proppant consisting of an essentially spherical particulate non-metallic material and placing a second proppant consisting essentially of an elongated material having a length to equivalent diameter greater than 5. By essentially spherical particulate non-metallic material is meant here any conventional proppant, well known to those skilled in the art of fracturing, and consisting, for instance, of sand, silica, synthetic organic particles, glass microspheres, ceramics including alumino-silicates, sintered bauxite and mixtures thereof, or deformable particulate material as described for instance in U.S. Pat. No. 6,330,916. In another embodiment, the wire-proppant is only added to a portion of the fracturing fluid, preferably the tail portion. In both case, the wire-proppant of the invention is not blended with the conventional fracture proppant material or if blended with it, the conventional material makes up no more than about 25% by weight of the total fracture proppant mixture, preferably no more than about 15% by weight.

Experimental

A test was made to compare proppant made of metallic balls, made of stainless steel SS 302, having an average diameter of about 1.6 mm and wire proppant manufactured by cutting an uncoated iron wire of SS 302 stainless steel into segments approximately 7.6 mm long. The wire was about 1.6 mm in diameter.

The proppant was deposited between two Ohio sandstone slabs in a fracture conductivity apparatus and subjected to a standard proppant pack conductivity test. The experiments were done at 100° F.: 2 lb/ft$^2$ proppant loading was used and 3 closure stresses, 3000, 6000 and 9000 psi (corresponding to about 20.6, 41.4 and 62 MPa) were examined. The permeability, fracture gap and conductivity results of steel balls and wires are shown in Table 1.

TABLE 1

| Closure Stress | Permeability (darcy) | | Fracture Gap (inch) | | Conductivity (md-ft) | |
|---|---|---|---|---|---|---|
| (psi) | Ball | Wire | Ball | Wire | Ball | Wire |
| 3000 | 3,703 | 10,335 | 0.085 | 0.119 | 26,232 | 102,398 |
| 6000 | 1,077 | 4,126 | 0.061 | 0.095 | 5,472 | 33,090 |
| 9000 | 705 | 1,304 | 0.064 | 0.076 | 3,174 | 8,249 |

The conductivity is the product of the permeability (in milliDarcy) and the fracture gap in (in feet).

The invention claimed is:

1. A method of fracturing a subterranean formation comprising injecting a fracturing fluid, into a hydraulic fracture created into a subterranean formation, wherein at least a portion of the fracturing fluid comprises at least one device actively transmitting data that provide information on the device position, and further comprising the step of assessing the fracture geometry based on the positions of said devices.

2. The method of claim 1, wherein said devices are electronic devices.

3. The method of claim 2, wherein said devices are radio frequency or other EM wave transmitters.

4. The method of claim 1, wherein said devices are—acoustic devices.

5. The method of claim 4, wherein said devices are ultrasonic transceivers.

6. The method of claim 1, wherein at least one device is pumped during the pad stage and at least one device is pumped during the tail portion.

7. The method of claim 1, wherein said devices also transmit information as to the temperature of the surrounding formation.

8. The method of claim 1, wherein said devices also transmit information as to the pressure.

9. The method of claim 1, wherein a plurality of devices is injected, said devices organized in a wireless network.

10. The method of claim 1, wherein the devices are electronic transmitters and the method further includes the deployment of at least an antenna.

11. The method of claim 10, wherein antennas are mounted on non-conductive balls that are pumped with the fluid and seat in some of the perforations relaying the signals from sensors behind the casing wall.

12. The method of claim 10, wherein the antenna is trailed by the transmitter within the fracture while the transmitter is pumped.

13. The method of claim 1, where the device is an optical fiber deployed through the perforation.

14. The method of claim 13, wherein the optical fiber is further deployed through the fracture.

15. The method of claim 1, wherein the geometry of the fracture is monitored in real-time during the hydraulic fracturing treatment.

* * * * *